US007487906B2

(12) United States Patent
Molinare et al.

(10) Patent No.: US 7,487,906 B2
(45) Date of Patent: Feb. 10, 2009

(54) PERSONAL CARE ARTICLE DISPENSING CARTON

(75) Inventors: Wayne Molinare, Simsbury, CT (US); Matthew Scott Okin, Cresskill, NJ (US)

(73) Assignee: Conopco, Inc., Englewood Cliffs, NJ (US)

( * ) Notice: Subject to any disclaimer, the term of this patent is extended or adjusted under 35 U.S.C. 154(b) by 461 days.

(21) Appl. No.: 11/381,776

(22) Filed: May 5, 2006

(65) Prior Publication Data

US 2007/0257095 A1 Nov. 8, 2007

(51) Int. Cl.
*B65D 17/32* (2006.01)

(52) U.S. Cl. ..... 229/222; 206/494; 221/302; 229/234

(58) Field of Classification Search ..... 229/222, 229/229, 234; 221/302, 305; 206/494
See application file for complete search history.

(56) References Cited

U.S. PATENT DOCUMENTS

| | | | | |
|---|---|---|---|---|
| 2,407,781 | A * | 9/1946 | Reynolds | 229/234 |
| 3,940,054 | A * | 2/1976 | Goebel et al. | 206/449 |
| 3,979,019 | A | 9/1976 | Bliss | |
| 3,982,685 | A * | 9/1976 | Shimada | 206/494 |
| 4,158,412 | A * | 6/1979 | Wysocki | 229/242 |
| 4,458,810 | A * | 7/1984 | Mahoney | 206/494 |
| 4,459,127 | A | 7/1984 | Kunzel | |
| 5,556,026 | A | 9/1996 | Blankitny | |
| 5,996,797 | A | 12/1999 | Flaig | |
| 6,015,045 | A * | 1/2000 | Joseph et al. | 206/494 |
| 6,761,269 | B2 | 7/2004 | Hamming | |
| 6,886,714 | B2 * | 5/2005 | Kruchoski et al. | 221/302 |
| 2003/0205613 | A1 | 11/2003 | Schliebner et al. | |
| 2006/0180645 | A1 * | 8/2006 | Takagi et al. | 229/229 |

FOREIGN PATENT DOCUMENTS

| | | |
|---|---|---|
| EP | 0 370 192 | 11/1988 |
| EP | 0 459 110 | 5/1990 |
| EP | 0 803 448 | 4/1996 |
| FR | 2 744 428 | 2/1996 |
| WO | 00/30955 | 6/2000 |

OTHER PUBLICATIONS

Co-Pending Application: Applicant: Okin et al.; U.S. Appl. No. 29/246,718; Filed: May 5, 2006; For: Carton For Dispensing Personal Care Articles.
Co-Pending Application: Applicant: Okin et al.; U.S. Appl. No. 29/246,719; Filed: May 5, 2006; For: Carton For Dispensing Personal Care Articles.

* cited by examiner

*Primary Examiner*—Gary E Elkins
(74) *Attorney, Agent, or Firm*—Milton L. Honig

(57) ABSTRACT

A towelette dispensing carton is provided which includes a deck panel with an elongate through-cut slot, a front panel adjoining the deck panel, a rear panel adjacent the deck panel, a bottom panel flanked on opposite edges by the front and rear panels, and a lid panel partially covering the deck panel. Right and left side panel systems close off ends of the carton. The lid panel features curved and straight sections along a leading edge, the respective sections being formed on opposite sides of a tab projecting from the leading edge, the tab being at a lesser distance ($L_1$) from one of right or left side panel systems than a distance from the other side panel system ($L_2$).

7 Claims, 2 Drawing Sheets

PERSONAL CARE ARTICLE DISPENSING CARTON

BACKGROUND OF THE INVENTION

1. Field of the Invention

The invention concerns a carton for dispensing personal care articles such as towelettes.

2. The Related Art

Disposable cloths, pads, sheets and tissues (collectively defined as towelettes) are established articles of commerce. Generally the towelettes are stacked one upon another. Sometimes they are also interleaved. Especially with fluid impregnated towelettes, a flexible fluid impervious soft plastic wrapping is used at least as an inner packaging. In most instances, an outer relatively rigid packaging is utilized for purposes of in-store display. The package also serves to reseal the articles against dust and other contamination. Much technology has gone into developing outer packaging for personal care articles, especially towelette stacks.

U.S. Pat. No. 5,996,797 (Flaig) discloses a folded carton surrounding a plastic pouch for storing/dispensing a stack of towelettes. The carton features a lid hingedly attached which overlies a dispensing opening and at least a portion of flanking panels. A tab is bent orthogonal to the lid and insertable into a slit formed within a front wall of the carton.

WO 00/30955 (Lohmann) discloses a dispenser for seal-edge bags in the form of a folded box. A deck panel of the box includes a perforated area and is overlain by a closure panel. An adhesive binds an under-surface of the closure panel to the perforated area. Upon lifting the closure panel, the perforated portion is ripped from the deck panel revealing a dispensing aperture for articles held therein.

Despite the plethora of dispensing cartons, there still is a need for improvements. For instance, once a seal of the carton has been broken, the lid may not be securely closable. There may also be difficulties in readily flipping open the lid.

SUMMARY OF THE INVENTION

A towelette dispensing carton is provided which includes:

a deck panel with an elongate through-cut slot and in a pre-initial opening of the carton having a perforated section;

a front panel adjoining the deck panel;

a rear panel adjacent the deck panel;

a bottom panel flanked on opposite edges by the front and rear panels;

right and left side panel systems closing off ends of the carton;

a lid panel adjoining the rear panel, partially covering the deck panel and having a leading and a trailing edge, the leading edge having a projecting tab, the trailing edge adhesively bonded to a portion of the deck panel and hingedly movable post-initial opening of the carton;

an area on an inner surface of the lid panel being adhesively bonded to the perforated section forming a dispensing aperture upon pulling the lid panel open; and wherein the improvement comprises a curved section and a straight section forming the leading edge of the lid panel, the respective sections being on opposite sides of the tab, the tab being at a lesser distance ($L_1$) from one of the right or left side panel system than a distance from the other side panel system ($L_2$).

BRIEF DESCRIPTION OF THE DRAWING

Various features and embodiments of this invention will now be described in more detail with reference to the accompanying drawing in which.

DETAILED DESCRIPTION OF THE INVENTION

Figure 1:
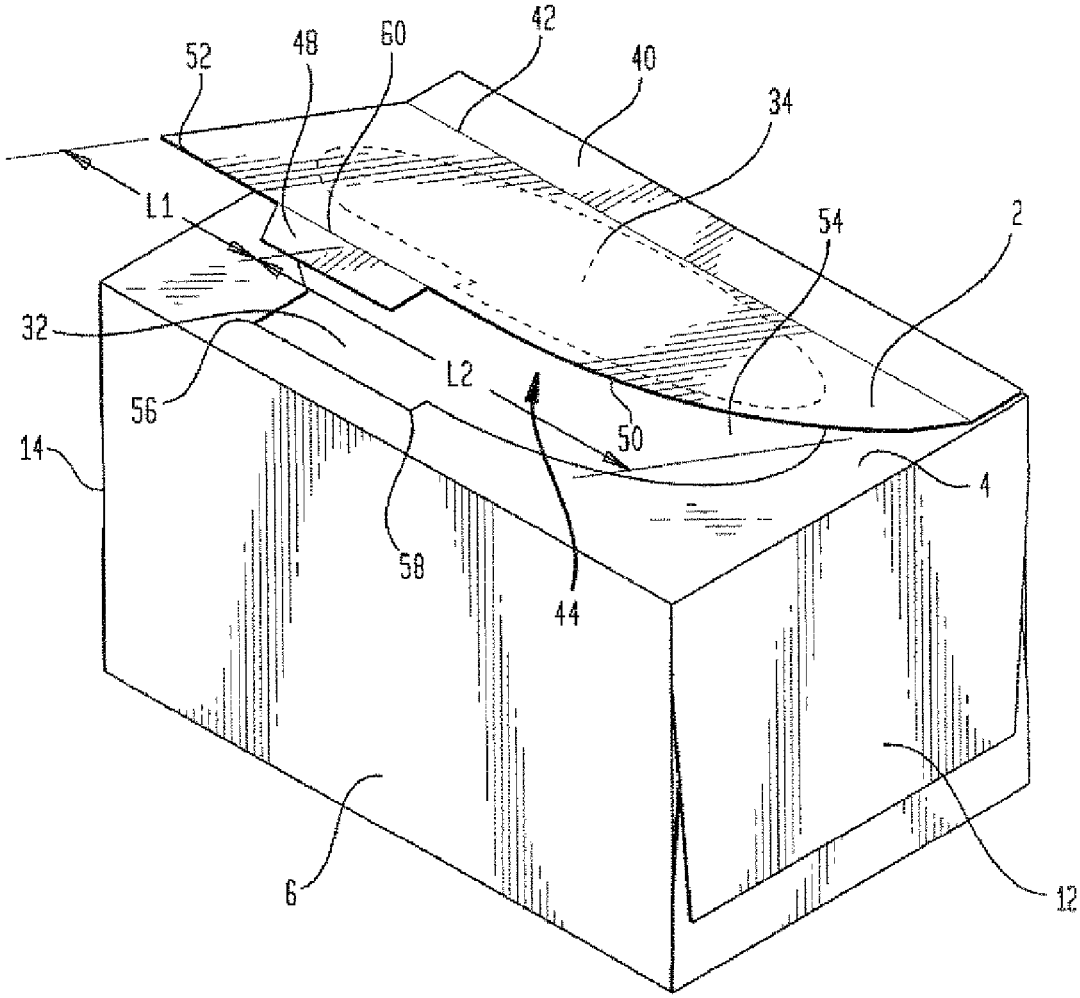
FIG. 1 is a front elevational view of the carton shown in a post-opening arrangement.

FIG. 1 illustrates the carton of the present invention in a post-initial opening arrangement. The carton features a lid panel 2, a deck panel 4, a front panel 6, a bottom panel 8 and a rear panel 10.

Figure 2:
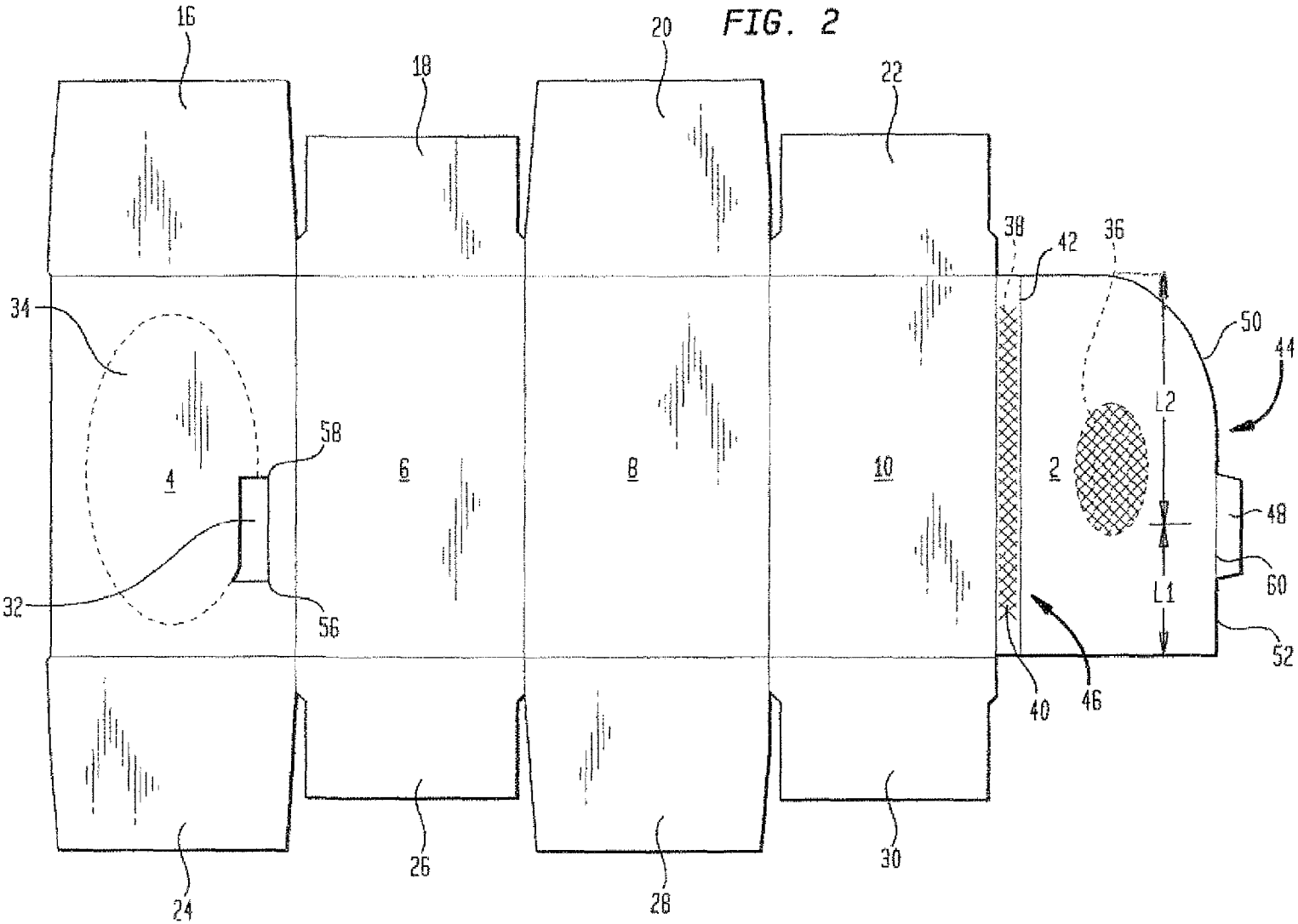
FIG. 2 is a top plan view of the carton in blank format.

FIG. 2 illustrates via the carton blank the arrangement of the several panels. The front panel 6 adjoins the deck panel 4. The rear panel 10 in folded mode lies adjacent the deck panel. Bottom panel 8 is flanked on opposite edges by front and rear panels. The lid panel 2 adjoins the rear panel and in folded mode partially covers the deck panel.

A right side panel system 12 and a left side panel system 14 close off ends of the carton. The right side panel system includes a right outer end flap 16 attached to the deck panel; right inner front flap 18 attached to the front panel; right inner end flap 20 attached to the bottom panel; and right inner rear flap 22 attached to the rear panel.

Likewise, the left side panel system 14 includes a left outer end flap 24 attached to the deck panel; left inner front flap 26 attached to the front panel; left inner end flap 28 attached to the bottom panel; and left inner rear flap 30 attached to the rear panel.

The deck panel includes an elongate through-cut slot 32. Previous to first (pre-initial) opening of the carton, the deck panel includes a perforated section 34 of oval configuration. An area 36 on an inner surface of the lid panel is treated with an adhesive. Upon assembly into the carton, area 36 is adhesively bonded to the perforated section 34. Upon initially pulling the lid open to unseal the carton, the perforated section is forcibly lifted from the deck panel becoming attached to the inner surface of the lid panel.

Adhesive is also applied along a longitudinal area 38 on the inner surface of the lid panel. This adhesive application ensures that a longitudinal section 40 remains firmly secure to the deck panel during opening of the lid panel. A crease line 42 defining a leading edge of longitudinal section serves as a pivot allowing hinged movement of the lid panel relative to the deck panel.

Further, the lid panel is bounded by a leading edge 44 and a trailing edge 46, the trailing edge being coincident with crease line 42. The leading edge includes a projecting tab 48.

Of particular importance to the present invention is a curved section 50 situated along the leading edge of the lid panel. Section 50 is separated from a straight section 52 of leading edge 46 by the projecting tab 48.

Tab 48 is positioned along the leading edge at a lesser distance ($L_1$), as measured from a mid point of the tab, from one of the right or left side panel system than a distance ($L_2$) from the other side panel system.

Subsequent to re-closing the carton, the lid panel can be closed by insertion of the projecting tab into the elongate slot 32. The slot with the now removed perforated section of the deck panel defines a single continuous dispensing opening 54. Further, the slot includes three sides and features two right (90°) angles 56, 58.

The projecting tab has a crease 60 along attachment to the leading edge of the lid panel. The crease allows the tab to bend downward into the slot to secure reclosure of the carton. The tab at an outermost edge does not extend beyond the deck panel in the pre-initial opening arrangement of the carton.

A multiplicity of folded towelettes may be stored for dispensing as a stack within the carton. These towelettes may be dry or fluid impregnated. When fluid impregnated, the stack will ordinarily be wrapped in a fluid impermeable plastic film forming a pouch with an adhesively resealable dispensing opening. The pouch will then be placed inside the carton.

Ordinarily the carton of the present invention will be formed of paperboard. One or more coatings may be placed on outer surfaces of the paperboard. For instance, coatings may be applied to achieve gloss and also to assist in achieving a better printing on the paperboard. Selected areas of the side panel systems may have differences in coatings to assist in adhesively sealing component flaps one to another.

What is claimed is:

1. A towelette dispensing carton comprising:

a deck panel with an elongate through-cut slot and in a pre-initial opening of the carton having a perforated section;

a front panel adjoining the deck panel;

a rear panel adjacent the deck panel;

a bottom panel flanked on opposite edges by the front and rear panels;

right and left side panel systems closing off ends of the carton;

a lid panel adjoining the rear panel and partially covering the deck panel and having a leading and a trailing edge, the leading edge having a projecting tab, the trailing edge adhesively bonded to a portion of the deck panel and hingedly movable post-initial opening of the carton;

an area on an inner surface of the lid panel being adhesively bonded to the perforated section forming a dispensing aperture upon pulling the lid panel open; and wherein the improvement comprises a curved section and a straight section forming the leading edge of the lid panel, the respective sections being on opposite sides of the tab, the tab being at a lesser distance ($L_1$) from one of the right or left side panel system than a distance from the other side panel system ($L_2$).

2. The carton according to claim 1 wherein the slot and the dispensing aperture define a single continuous dispensing opening.

3. The carton according to claim 1 wherein the slot comprises three sides and features two right (90°) angles.

4. The carton according to claim 1 wherein the perforated section is oval.

5. The carton according to claim 1 wherein the tab at an outermost edge does not extend beyond the deck panel in the pre-initial opening arrangement of the carton.

6. The carton according to claim 1 wherein the tab has a crease along the leading edge of the lid panel.

7. A blank for forming a dispensing carton comprising:

deck panel with an elongate through-cut slot and a section delineated by a perforation line, the line having first and second ends, the ends being separated from one another by the slot;

a front panel adjoining the deck panel;

a bottom panel adjoining the front panel;

a rear panel adjoining the bottom panel;

right inner rear flap attached to a first end of the rear panel and left inner rear flap attached to a second end of the rear panel;

a lid panel adjoining the rear panel and having a leading and a trailing edge, the leading edge having a projecting tab; and wherein the improvement comprises a curved section and a straight section forming the leading edge of the lid panel, the respective sections being on opposite of the tabs, the tab being at a lesser distance ($L_1$) from of the right inner rear flap than a distance ($L_2$) from the left inner rear flap.

* * * * *